United States Patent [19]

Flory et al.

[11] 4,091,351

[45] May 23, 1978

[54] PUSHBUTTON-OPERATED CIRCUIT BREAKER

[75] Inventors: Josef Flory, Reussbuhl; Ernst Kuhn, Lucerne, both of Switzerland

[73] Assignee: Weber AG, Fabrik Elektro-Technischer Artikel und Apparate, Emmenbrucke, Switzerland

[21] Appl. No.: 740,293

[22] Filed: Nov. 9, 1976

[30] Foreign Application Priority Data

Nov. 13, 1975 Germany ..... 2551054

[51] Int. Cl.[2] ..... H01H 71/16

[52] U.S. Cl. ..... 337/62; 337/66

[58] Field of Search ..... 337/62, 63, 64, 65, 337/66, 67

[56] References Cited

U.S. PATENT DOCUMENTS

| | | | |
|---|---|---|---|
| 3,706,057 | 12/1972 | Ellenberger | 337/66 |
| 3,708,776 | 1/1973 | Ellenberger | 337/66 |

*Primary Examiner*—George Harris

*Attorney, Agent, or Firm*—Browdy and Neimark

[57] ABSTRACT

A pushbutton-operated circuit breaker has a thermal release and an independent trip which can be mannually operated to trip the circuit breaker from the "on" position to the "off" position by depressing the pushbutton. A slide is provided within the switch which, when contacted by the pushbutton, forces a bimetallic spring to bend and release the switch. The slide is movable within the switch such that it is outside of the path of movement of the pushbutton when the circuit breaker is being switched from the "off" to the "on" position, but is engageable by the pushbutton when in the "on" position.

8 Claims, 8 Drawing Figures

PUSHBUTTON-OPERATED CIRCUIT BREAKER

FIELD OF THE INVENTION

The present invention relates to a pushbutton-operated circuit breaker with a thermal release and an independent trip, and more particularly to such a circuit breaker having a contact bridge which is swivelably mounted and displaceable by the pushbutton against the force of a spring, such contact bridge being capable of being brought into mesh with a stop behind a latching element, the element being connected with a bimetallic strip provided for thermal release, with a release mechanism actuable by the same pushbutton, with which the bimetallic strip is bendable in such manner that the contact bridge is released from the latching element.

BACKGROUND OF THE INVENTION

A circuit breaker of the general type described in the "Field of the Invention" is known from German Pat. No. 1,463,115, wherein the latching element is formed of two legs at an angle to one another and extending diagonally with respect to the central axis of the pushbutton, said legs being part of a curved metal plate fastened to the bimetallic strip. When the pushbutton is depressed into the switch housing, the contact bridge is guided smoothly by the one sloping leg of the metal plate until it locks. One end of the contact bridge rests against the other sloping leg of the metal plate after locking. The slopes make it possible to pull the pushbutton out of the "on" position again, whereby the corresponding end of the contact bridge slides along the metal plate and bends the bimetallic strip outward in such manner that the locking element releases the contact bridge. The disadvantage of this is that it becomes increasingly more difficult to pull the pushbutton out to release the switch as the contact bridge is held more firmly in its "on" position. This also means that as the force required to release the switch decreases, the force holding the contact bridge in the "on" position decreases, so that there is a danger that the switch can open inadvertently as a result of vibration. In addition, when installing a number of switches, it is necessary to have a greater lateral spacing, since the pushbutton must be surrounded by the fingers to pull it out, and this requires more room.

Circuit breakers are also known in which a special pushbutton is provided for manual shutoff. The arrangement of two separate pushbuttons, however, makes the installation of such switches more difficult, since two holes must be provided in the trim plate.

SUMMARY OF THE INVENTION

It is accordingly an object of the present invention to alleviate the hereinbefore mentioned problems associated with the prior art.

It is a further object to provide an improved pushbutton-operated circuit breaker with thermal release and independent trip.

It is another object of the present invention to design a circuit breaker of the type described hereinabove in such manner that a reliable latching of the contact bridge in the "on" position is ensured without greater force being required to release the switch, especially pulling force.

These and other objects are accomplished in accordance with the present invention by the fact that the release mechanism comprises a slide which projects into the path of movement of the pushbutton and is movable by the latter against the bimetallic spring or a part connecting therewith, and that the contact bridge and slide are provided with stops in such manner that the slide is outside the movement path of the pushbutton when the contact bridge is in the resting position, i.e., when the switch contact is open. This makes it possible to put the switch in the "on" position and the "off" position by the action of pressure on the pushbutton. It also makes it possible to use a latching element for the contact bridge which exerts a considerable holding force on the contact bridge without a correspondingly large force having to be applied to release it. In addition, it is possible when using several switches to mount said switches a minimum distance apart. The switch position can be ascertained visually by virtue of the considerable difference in the degree to which the pushbutton protrudes.

BRIEF DESCRIPTION OF THE DRAWINGS

The present invention is described in the following with reference to the drawings showing several embodiments, in which.

DESCRIPTION OF PREFERRED EMBODIMENTS

Figure 1A:
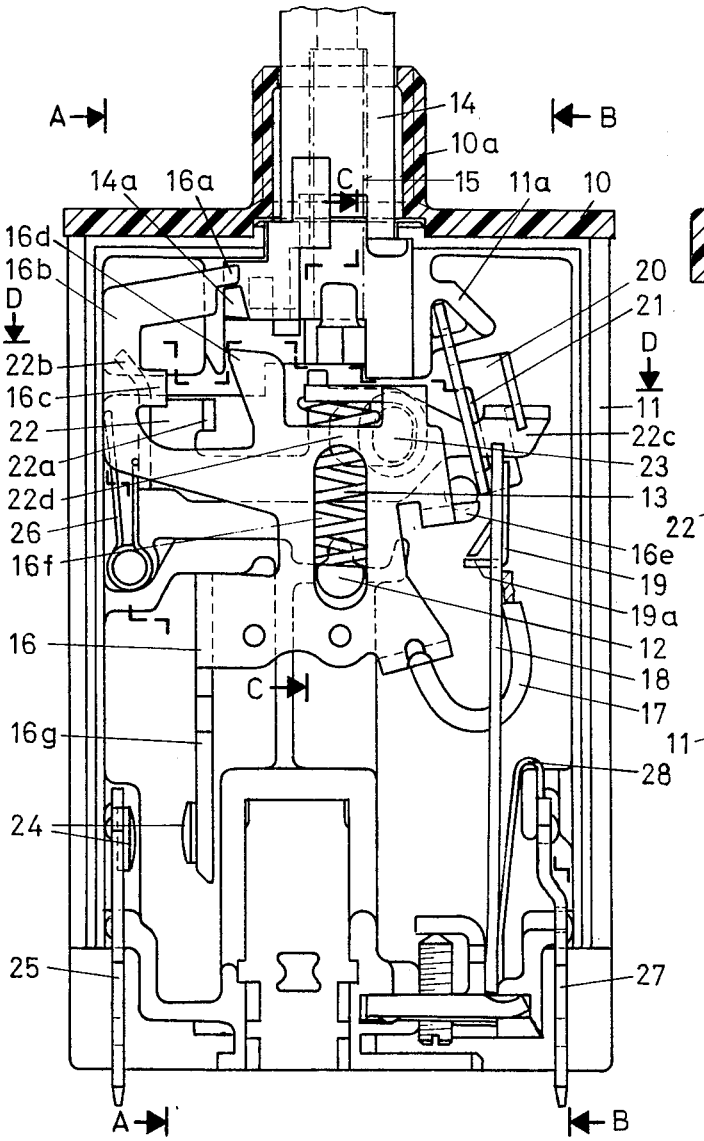
FIG. 1*a* is a front view of the circuit breaker according to the present invention in the "off" position.
Figure 2:
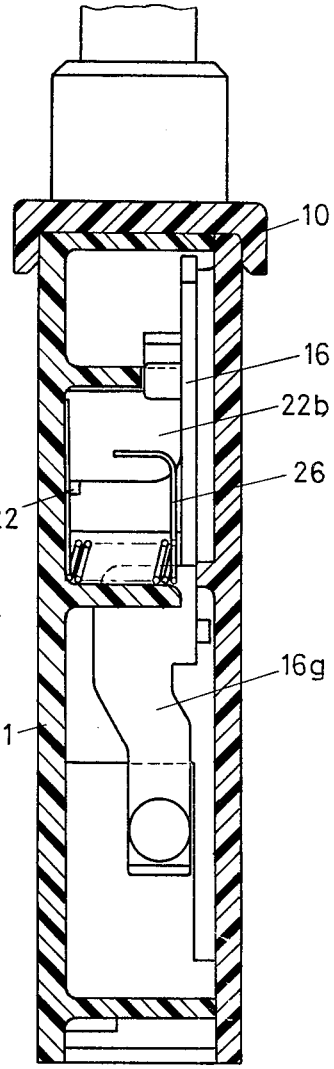
FIG. 2 is a cross section along line A—A in FIG. 1*a;*

In the embodiment of FIGS. 1 to 5, the switch housing 10, 11 consists preferably of plastic. An operating pushbutton 14 is provided, extending partially out of the housing. Contact bridge 16 is provided within the housing and has an arm 16*b* provided with a projection 16*a*. Spring 13 is tensioned between a support 12 connected to housing 11 and contact bridge 16. A spring 15 tends to return pushbutton 14 to its resting position. Contact bridge 16 is provided with an elongated slot 16*f*, with which support 12 meshes.

The operation of such a switch is known of itself, and therefore will only be mentioned briefly here. When pushbutton 14 is depressed from the "off" position of FIG. 1*a*, projection 14*a* comes to rest against stop 16*d* of contact bridge 16. As pushbutton 14 is further depressed, contact bridge 16 is moved against the force of spring 13, the contact bridge sliding longitudinally with repect to support 12 and resting against the switch housing with arm 16*b*. The pushbutton is pushed in until projection 16*e* on the contact bridge catches behind latching projection 19*a* of latching element 19 on bimetallic spring 18. When pushbutton 14 is then released, the contact bridge swivels clockwise into the "on" position shown in FIG. 1*b*, whereby stop 16*d* slides off stop 14*a* and contact arm 16*g* is moved abruptly against contact 25, so that contacts 24 are brought together. The circuit from contact 27 via copper strip 28, bimetallic spring 18 and connecting wire 17, contact bridge 16, and contact 24 to contact 25 is then closed. Since projection 14*a* on pushbutton 14 is now resting against arm 16*b* of contact bridge 16, pushbutton 14 projects to a lesser degree from housing 10 than in the "off" position as shown in FIG. 1*a*, so that the "on" position can be detected visually.

Figure 1B:
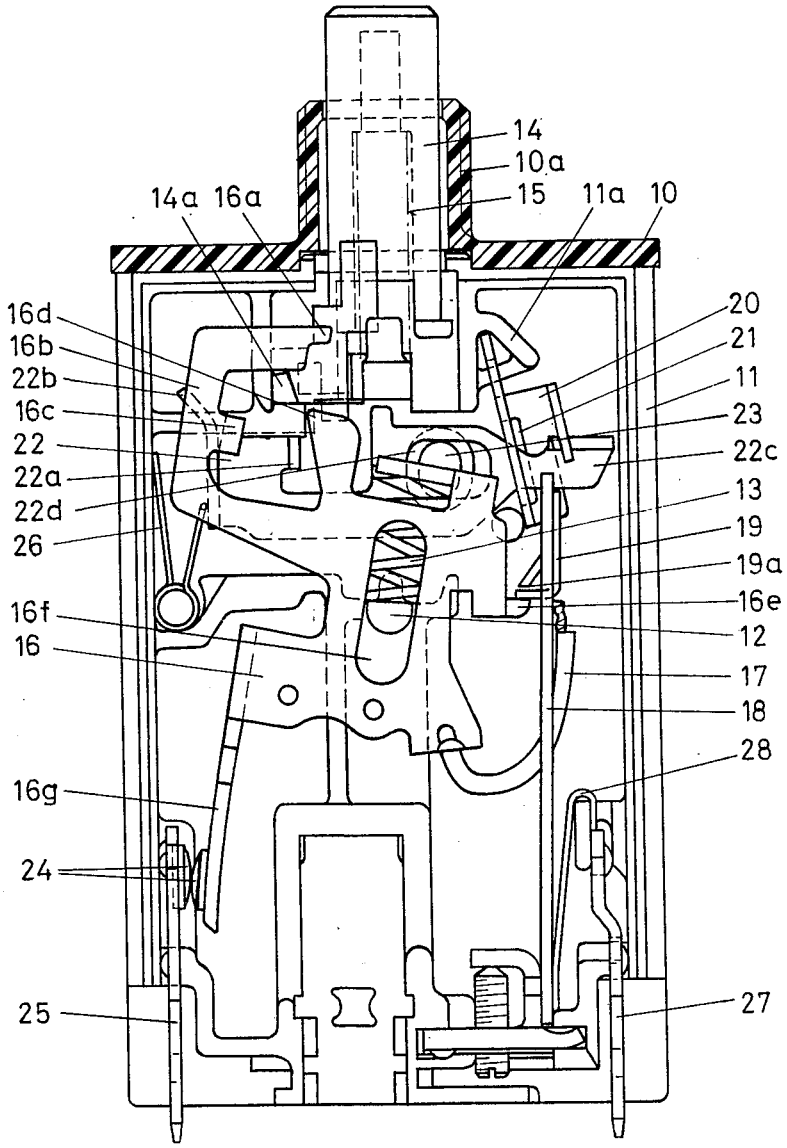
FIG. 1*b* shows the switch according to FIG. 1*a* in the "on" position.
Figure 3:
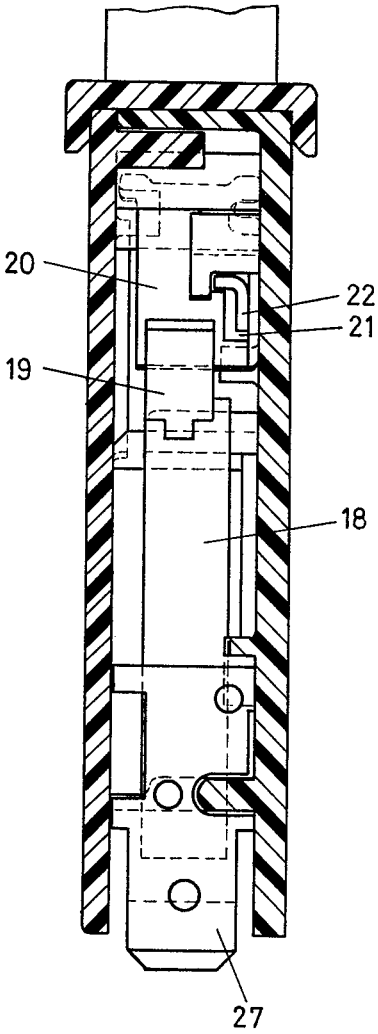
FIG. 3 is a section along line B—B in FIG. 1*a;*
Figure 4:
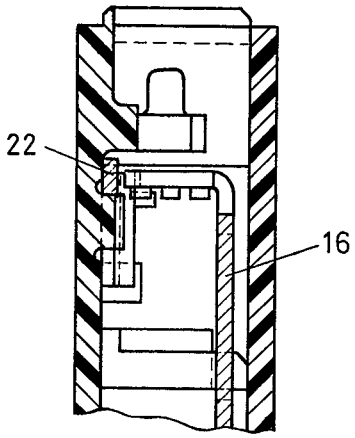
FIG. 4 is a partial representation of the switch, in a section along line C—C in FIG. 1*a;*
Figure 5:
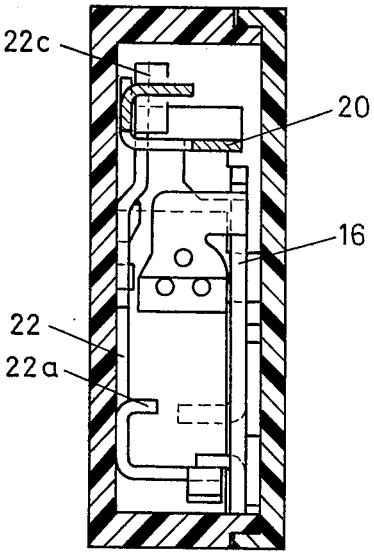
FIG. 5 is a section along line D—D in FIG. 1*a;*

When the current passing through bimetallic spring 18 exceeds a certain value in the "on" position as shown in FIG. 1*b*, bimetallic spring 18 is heated, thus bending clockwise until stop 16*e* on contact bridge 16 is released, whereupon the contact bridge is brought back by spring 13 to the position shown in FIG. 1*a* and contact 24 is opened. Projection 14*a* on pushbutton 14 keeps contact bridge 16 in the position shown in FIG. 1*a*.

A slide 22 is provided in order to manually connect the switch from the "on" position shown in FIG. 1*b* to the "off" position shown in FIG. 1*a*. The slide 22 is mounted with an elongated hole 22*d* on a projection 23 in housing 11 so that it is lengthwise displaceable as well as swivelable. End 22*c* of slide 22 passes through an opening 21 in a release element 20, said release element 20 being swivelably mounted with one end in a rocker bearing 11*a* in housing 11, and extending at an angle to the lengthwise axis of the switch down to the free end of bimetallic strip 18. When the end 22*c* of slide 22 causes release element 20 to exert a force on bimetallic spring 18, said force distorting the bimetallic spring clockwise, latching projection 19*a* of latching element 19 is brought out of mesh with projection 16*e* of contact bridge 16 and the switch is returned to the position shown in FIG. 1*a* with switch contacts 24 opened.

The slide 22 is also provided with a stop 22*b*, against which one end of a spring 26 rests, the other end of said spring being supported on housing 11. Spring 26 presses slide 22 rightward as shown in FIG. 1*a*. Contact bridge 16 is provided with a stop 16*c* which meshes with stop 22*b* when contact bridge 16 is in the resting position as shown in FIG. 1*a*, and thereby holds slide 22 in a position relative to the force of spring 26 wherein a further stop 22*a* on slide 22 is located outside the area of movement of pushbutton 14 and/or pushbutton stop 14*a*.

In the "on" position of contact bridge 16, as shown in FIG. 1*b*, however, the latter, as already mentioned, is swiveled approximately clockwise relative to the "off" position shown in FIG. 1*a*, whereby stop 16*c* is in a position located futher to the right, so that spring 26 can push slide 22 further to the right, as can be seen in FIG. 1*b*. The causes projection 22*a* of slide 22 to enter the area of movement of pushbutton 14, so that the latter may make contact with projection 22*a* by means of its projection 14*a* upon actuation following the switch being placed in the "on" position. When pushbutton 14 is so depressed from the "on" position of FIG. 1*b*, projection 22*a* is moved downward, causing the end 22*c* of the slide to move upward, thus causing release element 20 to rotate counterclockwise about rocker housing 11*a*, and in turn forcing the bending of the bimetallic spring 18 thereby releasing projection 16*e* of contact bridge 16 from detention by holding projection 19, permitting the release of the switch to take place.

Figure 6:
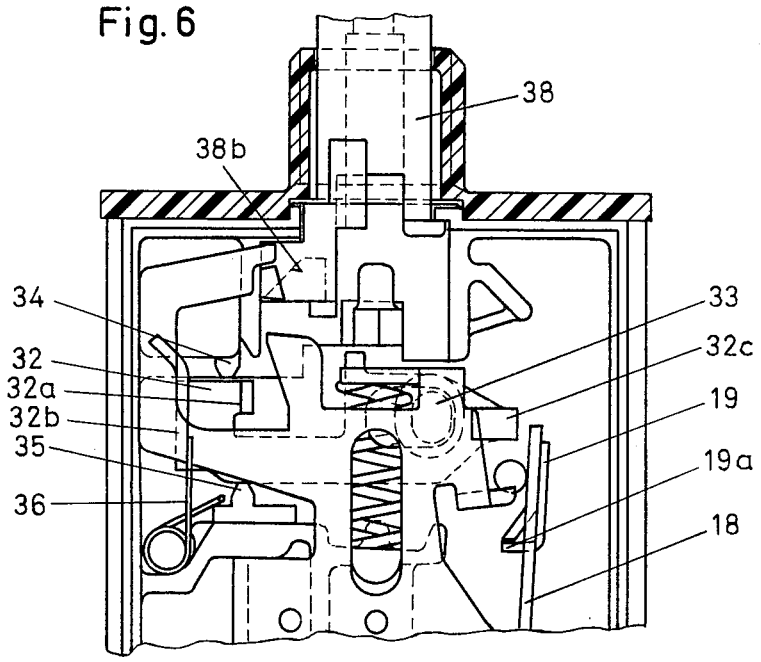
FIG. 6 is a partial representation of a modified embodiment of the switch according to the present invention.

The embodiment of the switch shown partially in FIG. 6 corresponds essentially to the embodiment shown in FIGS. 1 to 5. The only difference is the release mechanism. Here the slide is represented by 32, and is guided in the housing by parts 33, 34 and 35 thereon in such manner that slide 32 can exert only a rectilinear motion in the direction of bimetallic spring 18. Slide 32 is forced away from bimetallic spring 18 by a spring 36. In the position of the contact bridge shown in FIG. 6, i.e., in the "off" position of the switch, projection 32*a* of slide 32 is located outside the path of movement of pushbutton 38 so that it is not actuated by pushbutton 38 when the switch is being switched into the "on" position.

When the switch is in the "on" position, however, i.e., when the contact bridge has swiveled clockwise, a detent on the contact bridge (not shown) comes to rest against a stop 32*b* on the slide 32, causing slide 32 to move in the direction of the bimetallic spring 18 to such a distance that projection 32*a* of slide 32 reaches the area of movement of pushbutton 38. Pushbutton 38 is provided with a curved ramp 38*b*, which moves projection 32*a* further in the direction of bimetallic spring 18 as pushbutton 38 moves downward, thereby causing the end 32*c* of slide 32 to mesh with the end of bimetallic spring 18 and push the latter down until the contact bridge is released from latching element 19*a*.

Figure 7:
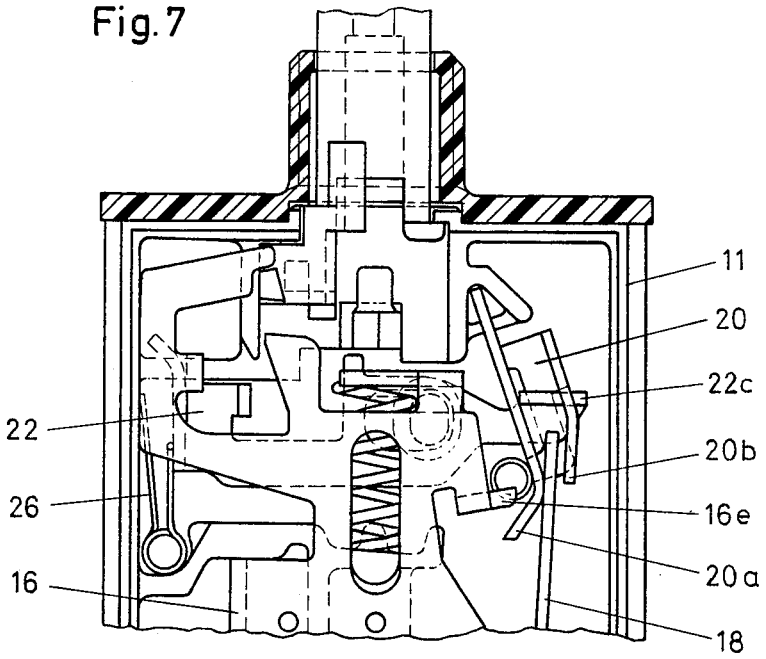
FIG. 7 is a further modification of the switch according to the present invention.

The embodiment shown in FIG. 7 largely corresonds to that shown in FIGS. 1*a* and 1*b*. However, release element 20 is provided with projections 20*a* and 20*b*, which surround the end of bimetallic spring 18. This forms the projection 20*a* of the release element as a latching element for projection 16*e* of contact bridge 16. Hence, holding projection 19 can be replaced by projection 20*a* of release element 20.

As can be seen from the various embodiments, switch housing 10, 11 is provided with a threaded bushing 10*a* through which the pushbutton passes, by means of which bushing the entire switch housing can be installed in a control panel or the like in a very simple manner.

It will be obvious to those skilled in the art that various changes may be made without departing from the scope of the invention and the invention is not to be considered limited to what is shown in the drawings and described in the specification.

What is claimed is:

1. In a pushbutton-actuated circuit breaker with a thermal release and an independent trip, comprising a housing, a pushbutton extending through said housing, a contact bridge swivelably and longitudinally displaceably mounted within said housing, said contact bridge being displaceable longitudinally by depression of said pushbutton, spring means for opposing said longitudinal displacement of said contact bridge, latching means for latching said contact bridge after displacement by said pushbutton, allowing said contact bridge to swivel into the "on " position after release of said pushbutton, and holding the said contact bridge in the "on" position, a thermally bendable bimetallic strip associated with said latching means such that, when said contact bridge is latched in the "on" position by said latching means, said latching means releases said contact bridge upon bending of said bimetallic strip, and release means, actuable by said pushbutton, for causing said bimetallic strip to be bent to an extent sufficient to release said latching means, the improvement wherein said release means comprises:

a moveable slide means for causing said bimetallic strip to be bent upon displacement by said pushbutton means, said slide means being operatively connected to said contact bridge such that when said contact bridge is in the "off" position, said slide means is disposed outside the path of travel of said pushbutton and thus cannot be displaced thereby, and when said contact bridge is in the "on" position, said slide means is disposed along the path of travel of said pushbutton and is thus capable of being displaced thereby.

2. A circuit breaker in accordance with claim 1 wherein said slide means has a projection thereon which is displaced by said pushbutton when said slide means is disposed such that said projection is in the path of movement of said pushbutton, and wherein said slide means and said contact means are each provided with a stop, said stops being engageable with one another, said release means further including biasing means for biasing said stop on said slide means into contact with said stop on said contact bridge, said stops, in cooperation with said biasing means, effecting a movement of said projection on said slide means upon motion of said contact bridge between the "on" and "off" positions.

3. A circuit breaker in accordance with claim 2 wherein said biasing means biases said slide means to a position whereby said projection is in the path of movement of said pushbutton.

4. A circuit breaker in accordance with claim 2 wherein said slide means is both longitudinally, in a direction substantially perpendicular to the axis of longitudinal displacement of the pushbutton, displaceably and swivelably mounted in said housing, said contact bridge causing said longitudinal displacement and said pushbutton causing said swivel displacement, and wherein said release means further includes a release element swivelably connected to said slide means and swiveling of said slide means causes said release element to bend said bimetallic strip.

5. A circuit breaker in accordance with claim 4 wherein said release element has an opening therein for accepting the end of said slide means opposite said projection, and wherein said release element is swivelably mounted at one end in a rocker bearing disposed in said housing, extends at an angle to the longitudinal axis of said slide means and contacts said bimetallic strip at the other end thereof, whereby, when the circuit breaker is in the "on" position, depression of said projection by said pushbutton causes said slide means to swivel the end of said slide means opposite said projection thus causing said release element to swivel within said rocker bearing and thereby cause said bimetallic strip to bend.

6. A circuit breaker in accordance with claim 5 wherein said release element has a projection thereon constituting said latching means.

7. A circuit breaker in accordance with claim 2 wherein said biasing means biases said slide means to a position whereby said projection is out of the path of movement of said pushbutton.

8. A circuit breaker in accordance with claim 2 wherein said slide means is longitudinally, in a direction substantially perpendicular to the axis of longitudinal displacement of the pushbutton, displaceably mounted in said housing, and wherein said pushbutton has a guide ramp thereon, said guide ramp causing longitudinal displacement of said slide means when said projection is contacted by said pushbutton, whereby motion of said contact bridge into the "on" position causes said slide means to move into the path of movement of said pushbutton, and subsequent actuation of said pushbutton causes sufficient further longitudinal movement of said slide means to cause said bimetallic strip to bend.

* * * * *